United States Patent [19]

Andersson

[11] Patent Number: 4,681,246

[45] Date of Patent: Jul. 21, 1987

[54] SKI HOLDING DEVICE

[76] Inventor: Denny Andersson, Vistavarvsvägen 163, 122 43 Enskede, Sweden

[21] Appl. No.: 800,210

[22] Filed: Nov. 21, 1985

[30] Foreign Application Priority Data

Nov. 21, 1984 [SE] Sweden ..... 8405866

[51] Int. Cl.[4] ..... A45F 5/00

[52] U.S. Cl. ..... 224/267; 224/222; 224/253

[58] Field of Search ..... 224/253, 222, 917, 916, 224/267

[56] References Cited

U.S. PATENT DOCUMENTS

| | | | |
|---|---|---|---|
| 2,822,116 | 2/1958 | Smalley et al. | 224/253 X |
| 3,208,653 | 9/1965 | Wallace | 224/222 |
| 3,232,501 | 2/1966 | Merenda | 224/916 X |
| 3,294,298 | 12/1966 | Danielson | 224/253 X |
| 3,322,311 | 5/1967 | Homer | 224/222 |
| 4,103,807 | 8/1978 | Lyon et al. | 224/222 |
| 4,363,433 | 12/1982 | Jaques | 224/253 |
| 4,588,116 | 5/1986 | Litman | 224/253 |

FOREIGN PATENT DOCUMENTS

| | | | |
|---|---|---|---|
| 72856 | 12/1947 | Norway | 224/222 |

*Primary Examiner*—Stephen Marcus
*Assistant Examiner*—Robert M. Petrik
*Attorney, Agent, or Firm*—Nies, Webner, Kurz & Bergert

[57] ABSTRACT

A ski holding device to be utilized for carrying skis, especially skis for downhill running. According to the invention, the ski holding device comprises an upwardly open box (2) to be placed on the outside of a boot, which box has a horizontal cross-section, which as to width and, respectively, length exceeds the thickness and, respectively, width of the rear ends of a pair of skis, in which box the rear ends of a pair of skis are intended to be slipped down and supported by the bottom portion (8) of the box (2).

5 Claims, 6 Drawing Figures

SKI HOLDING DEVICE

This invention relates to a ski holding device of a kind rendering it for a person easier to carry skis. Skis of all sorts of types, but especially skis for downhill running, are relatively heavy and unwieldy to carry. Normally such skis are carried in such a way, that two skis are laid together and carried on one shoulder. Skis, however, are of angular shape and hard. As, besides, the ski-bindings often comprise many projecting portions and details, e.g. adjusting knobs and ski-brakes, it is generally uncomfortable to carry skis of one shoulder. The skis, moreover, easily tear holes at the shoulder in the clothes. It is, for natural reasons, for children still more difficult than for adults to carry the skis on one shoulder.

The present invention relates to a ski holding device, which renders the carrying of skis, especially of skis for downhill running, substantially easier.

The present invention, thus, relates to a ski holding device, which is intended to be utilized at the carrying of skis, especially of downhill running skis. The invention is characterized, in that the ski holding device comprises an upwardly open box, which is to be placed on the outside of a boot, and which has a horizontal cross-section, which as to its width and, respectively, length exceeds the thickness and, respectively width of the rear ends of a pair of skis, and into which box the rear ends of a pair of skis are intended to be slipped down and be supported by the bottom portion of the box.

Figure 1:
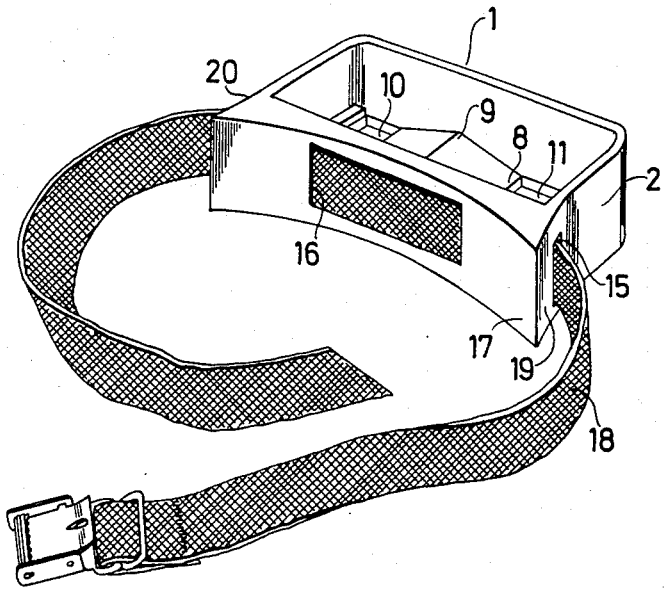
Figure 2:
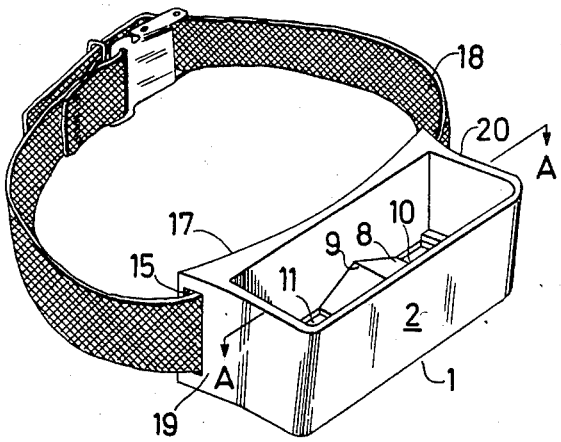
Figure 3:
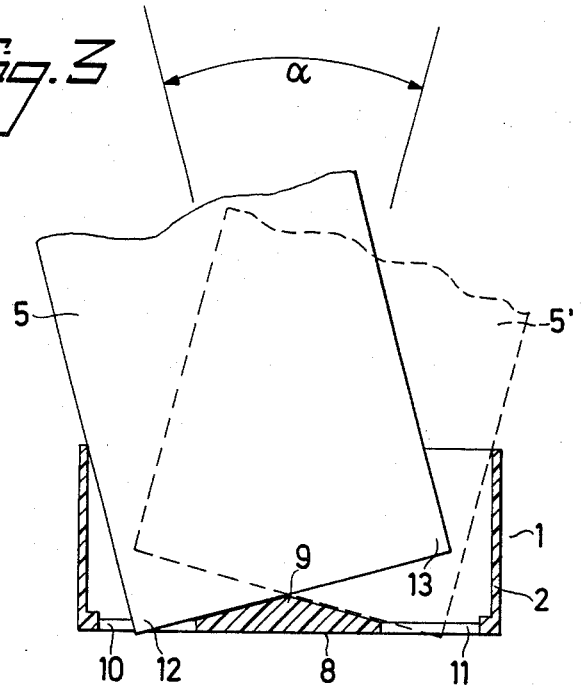
Figure 4:
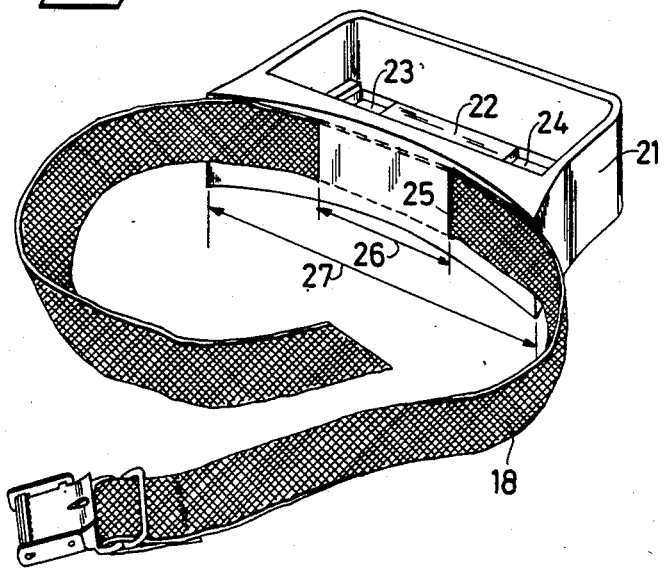
Figure 5:
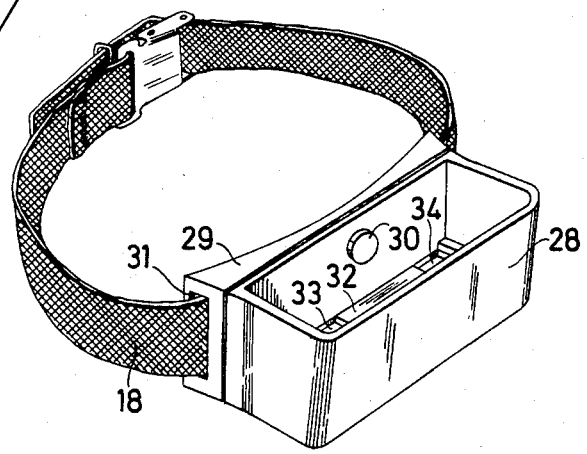
Figure 6:
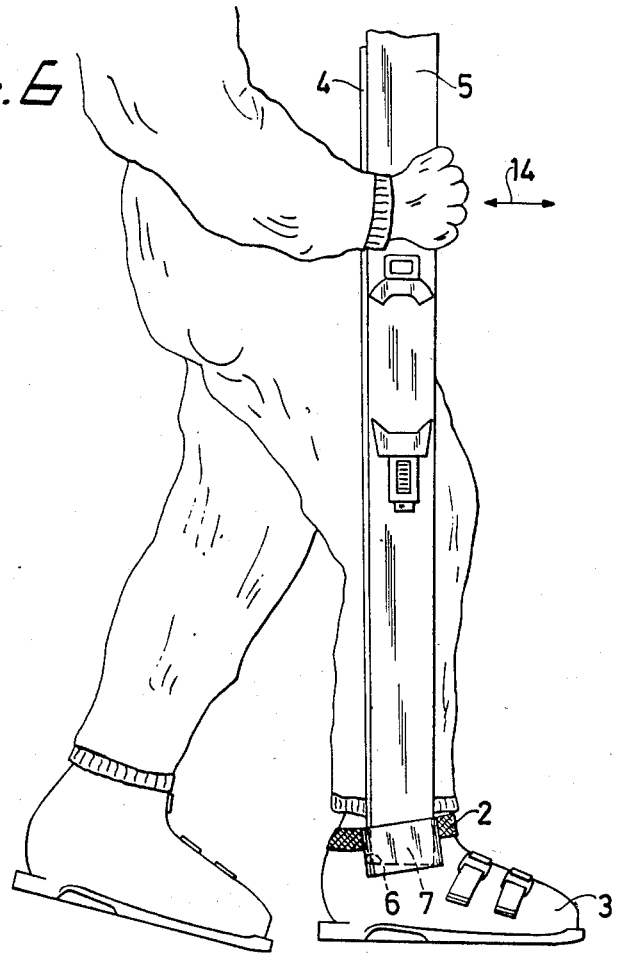

The invention is described in greater detail in the following, with reference to embodiments shown in the accompanying drawings, in which FIGS. 1 and 2 were perspective views of a ski holding device according to a first embodiment, FIG. 3 is a section along the line A—A in FIG. 2, FIG. 4 is a perspective view of a ski holding device according to a second embodiment, FIG. 5 is a perspective view of a ski holding device according to a third embodiment, FIG. 6 shows a ski holding device according to the invention mounted on a ski boot.

In the FIGS. 1, 2 and 3 a ski holding device 1 according to a first embodiment of the invention is shown. The ski holding device 1 comprises an upwardly open box 2 to be placed on the outside of a boot 3, see FIG. 3. The box 2 has a horizontal cross-section, which as to width and, respectively, length exceeds the thickness and, respectively, width of the rear or blunt ends 6,7 of a pair of skis 4,5. The rear ends of a pair of skis 4,5 are intended to be slipped down into the box 2 and be supported by the bottom portion 8 of the box.

According to a first embodiment, a ridge 9 is located in the bottom portion 8 of the box 2 and extends in a direction transverse to the longitudinal direction of the box. As illustrated in FIG. 3, the rear ends 6,7 of a pair of skis 4,5 are intended to rest on said ridge. On each side of said ridge apertures 10, 11 are located, each of which has a size permitting the rear corners 12,13 of a pair of skis to be inserted into and through the aperture, as illustrated in FIG. 3.

At an embodiment where the box is attached to a boot 3 in such a way, that the box 2 cannot, or to a very limited extent, be turned relative to the boot, said ridge 9 and apertures 10,11 imply, that a pair of skis 5 can be angled relative to the box where the rear ends of the pair of skis abut the ridge 9 substantially at the centre of the ends. As illustrated in FIG. 3, the skis can be angled from the position 5 indicated by fully drawn lines to the position 5' indicated by dashed lines, which corresponds to an angle $\alpha$. Depending on the height of the ridge 9 and the length of the apertures 10,11 in a direction from the left to the right in FIG. 3, the angle $\alpha$ can be varied. A suitable angle $\alpha$ can be of the magnitude 30°.

At such an embodiment the skis very easily can be moved forth and back by hand in the directions 14 indicated in FIG. 3. Hereby the hand and foot can be moved in a normal way when a person carries along the skis in the way illustrated in FIG. 3.

For attaching the box 2 to a boot 3, according to one embodiment one or several grooves (slots) 15,16 are located in that portion 17 of the box 2 which is intended to be nearest to the boot 3. In said groove or grooves a catching belt 18 extends, which is intended to be clamped about the leg of a boot as illustrated in FIG. 3. In cases when the bottom of the box is provided with a ridge 9, the grooves preferably extend from the outer edges 19,20 of the box, see FIGS. 1 and 2, in order thereby to be able to firmly attach the box to a boot, so that the box only very restrictedly can be turned relative to the boot.

According to a second embodiment of the invention illustrated in FIG. 4, the bottom 22 of the box 21 is plane or substantially plane. In the bottom a plurality of apertures 23,24 are located to provide sufficient draining and to make it possible to clean the box from snow. This object, of course, also is achieved by the apertures 10,11 at the embodiment described above. Due to the planeness of the box bottom, however, it is desired so to design the ski holding device that the box can be turned relative to the boot through an angle of about 30°. According to one embodiment, this is achieved in that one 25 or several grooves for a catching belt 18 are provided, which groove or grooves are formed so that the length 26, along which the catching belt 18 is attached relative to the box 21, is substantially shorter than the entire length 27 of the box. The catching belt 18 hereby serves as a link. The shorter the length 26, the more the box 21 can be turned for the same temsion in the catching belt 18.

According to a third embodiment of the invention, the box 28 is rotatably connected to an attachment member 29 via a joint 30. As appears from FIG. 5, the attachment member 29 together with the box 28 have about the same shape as the box 21 in FIG. 4. The joint 30 is a through pin attached in the attachment member 29 and, respectively, box 28. According to this embodiment, the attachment member is provided with one or several grooves 31 designed in a way corresponding to the grooves 15,16 shown in FIG. 1, viz. so that the attachment member can be clamped on the boot substantially non-rotary by means of the catching belt 18. According to this embodiment, the bottom 32 of the box is designed as a plane bottom with apertures 33,34. According to a fourth embodiment, which is not illustrated in the accompanying Figures, the box is a part integrated with a boot. In this case, according to one embodiment an attachment member corresponding to the attachment member 29 can be formed in the leg of the boot, while the box 28 is supported by a joint 30 relative to the boot. According to another embodiment, a box can be formed directly in the leg of the boot. At a further embodiment, a box 2 of the design shown in FIG. 1 can be arranged so as to be inserted down into a dovetail groove formed in the boot leg, which groove is capable to enclose the pointed corners 35,36 and adjacent portions of the box 2.

The inner dimensions of the box, for example, are such that the length is 8–10 cm, the width 2–3 cm, and the height 2–3 cm. The inner measures of the box, of course, are to be adapted to the type of skis to be carried. The box preferably is made of a high-quality plastic material, for example so-called ABS-plastic.

It is obvious that the ski holding device according to the invention can be designed in ways different from those described above without abandoning the invention idea, viz. so to arrange a ski holding device on a boot that the rear ends of a pair of skis are supported by the box.

The present invention, thus, must not be regarded restricted to the embodiments set forth above, but can be varied within the scope defined in the attached claims.

I claim:

1. A ski holding device to be utilized for carrying skis, especially skis for downhill running, characterized in that the ski holding device comprises an upwardly open box (2;21;28), with a bottom wall portion, front and rear walls and side walls, to be placed on the outside of a boot, which box has a horizontal interior cross-section, which is essentially rectangular and as to the width and, respectively, length exceeds the thickness and, respectively, width of the blunt ends of a pair of skis, into which box the blunt ends of a pair of skis are intended to be slipped down and supported by said bottom wall portion (8;22;32); the interior of said bottom wall portion including a ridge (9), intermediate and spaced away from said front and rear walls of said box and extending transverse to the side walls of said box, said ridge constituting a pivot abutment upon which an intermediate surface portion of said blunt (rear) ends of the pair of skis are intended to rest; and said bottom wall portion include apertures (10,11), one located in each of the spaces between said ridge and said front and rear walls of the box and thus being front and rear apertures respectively, each said aperture having a size enabling associated rear corner portions of the blunt ends of a pair of skis, placed in said box, to project down into and through an associated front or rear aperture.

2. A ski holding device as defined in claim 1, wherein said ridge is inclined upwardly from adjacent the front and rear aperture to a laterally disposed mid-portion of said ridge substantially centered between the front and rear walls of said box.

3. A ski holding device as defined in claim 1, characterized in that the box comprises at least one groove (15,16;31;25) in that portion (17;29) which is intended to be located nearest to a boot, in which groove or grooves (15,16;31;25) a catching belt (18) extends, which is intended to be clamped about the leg of a boot.

4. A ski holding device as defined in claim 1, characterized in that the box (28) is rotatably connected to an attachment member (29) via a joint (30), which attachment member (29) is to be attached to the leg of a boot.

5. A ski holding device as defined in claim 1, characterized in that the box (2) is a part integrated with a boot.

* * * * *